US005647119A

United States Patent [19]

Bourbeau et al.

[11] Patent Number: 5,647,119

[45] Date of Patent: Jul. 15, 1997

[54] CABLE TERMINATING TOOL

[75] Inventors: Roger R. Bourbeau, Glastonbury; David L. Morrow, Chester, both of Conn.

[73] Assignee: Ben Hughes Communication Products Company, Chester, Conn.

[21] Appl. No.: 506,660

[22] Filed: Jul. 25, 1995

[51] Int. Cl.[6] ..... H01R 43/042

[52] U.S. Cl. ..... 29/751; 29/753; 29/760; 29/863; 72/409.14

[58] Field of Search ..... 29/33 M, 751, 29/753, 758, 760, 863, 268; 7/107; 72/409.13, 410, 409.06, 409.14, 412

[56] References Cited

U.S. PATENT DOCUMENTS

| | | | |
|---|---|---|---|
| 2,369,180 | 2/1945 | Rosenthal | 29/751 X |
| 3,094,774 | 6/1963 | Nazarow et al. | 29/203 |
| 3,325,885 | 6/1967 | Ziegler, Jr. et al. | 29/751 |
| 3,588,982 | 6/1971 | Ziegler, Jr. | 29/751 |
| 4,227,299 | 10/1980 | Kuehling | 29/751 |
| 4,649,634 | 3/1987 | Mykkanen | 29/751 |
| 4,667,398 | 5/1987 | Leiby | 29/749 |
| 4,765,176 | 8/1988 | Geisser | 29/751 X |
| 5,040,288 | 8/1991 | Nilsson | 29/751 |
| 5,168,743 | 12/1992 | Schrader | 72/410 |
| 5,211,049 | 5/1993 | Lucas | 72/410 |
| 5,307,553 | 5/1994 | Frohlich | 29/566 |
| 5,392,508 | 2/1995 | Holliday et al. | 29/751 |

FOREIGN PATENT DOCUMENTS

| | | | |
|---|---|---|---|
| 2018901 | 4/1979 | Germany | 29/751 |
| 6176842 | 6/1994 | Japan | 29/863 |

OTHER PUBLICATIONS

One document AMP Light Crimp Tool, Published in America's Network, Aug. 15, 1994.

*Primary Examiner*—Peter Vo
*Attorney, Agent, or Firm*—McCormick, Paulding & Huber

[57] ABSTRACT

A hand tool for assembling a compression type connector on the end portion of an associated insulated electrical cable has a pair of pistol grip handles pivotably moveable relative to each other. A pair of opposing cable retaining members pivotally supported on a tool holder carried by one of the handles releasably retains a cable and an associated connector engaged with the cable in general coaxial alignment with an axially elongated moveable plunger carried by the tool holder and also defines a 360° annular bearing surface surrounding the cable and upon which the connector is seated when pressure is applied to the connector by the plunger. The plunger is connected to the other of the handles by a toggle link and is moved toward the bearing surface to apply axial pressure to the connector by operating the handles. The plunger is adjustable to adapt the tool to apply compression type connector fittings produced by various connector manufactures.

27 Claims, 3 Drawing Sheets

CABLE TERMINATING TOOL

BACKGROUND OF THE INVENTION

This invention relates in general to cable terminating tools and deals more particularly with an improved hand tool for securing a compression type connector to the end portion of an insulated electrical cable.

The tool of the present invention is adapted to attach to an end of an insulated electrical cable a compression type connector fitting which is positioned on the prepared end portion of a cable and has a weakened annular band of material adapted to collapse radially inwardly and into crimping engagement with an end portion of the outer insulation jacket on the cable in response to a axially directed compressive force applied to the connector.

Connectors of the aforedescribed type are produced by several connector manufacturers. However, tools presently available for applying such connectors generally do not provide complete support for a connector while it is being compressed to ensure that the required compressive force is evenly applied to the connector to fully activate the connector.

It is a general aim of the present invention to provide an improved hand tool of simple, durable construction for activating connectors of the aforedescribed general type produced by several connector manufactures and which vary in size and/or configuration. It is a further aim of the invention to provide an improved tool which includes a cable positioning and retaining device which provides full 360 degree support for a connector during the connector compression cycle and assures proper alignment of a connector and cable in the tool and substantially uniform application of force to the connector to enable faster, more consistent connector activation.

SUMMARY OF THE INVENTION

In accordance with the invention, a cable terminating tool for applying a compression type electrical connector fitting to an insulated electrical cable comprises a tool holder, cable retaining means supported on the tool holder for positioning and retaining a cable to be terminated and including a pair of cable retaining members supported on said tool holder for movement away from each other to a cable receiving position to receive therebetween a portion of an axially elongated cable to be terminated and toward each other to a cable retaining position to align and releasably retain an associated portion of the cable therebetween. The cable retaining members have opposing arcuate jaws which encircle the associated portion of the cable in the cable retaining position and cooperate to define a generally radially disposed annular bearing surface for engaging and supporting an annular end portion of a connector received on an end portion of a cable positioned in the tool. An axially elongated plunger assmebly supported on the tool holder for axial movement generally toward and away from the bearing surface moves in response to the operation of a manual operating means to apply compressive force to the connector.

DETAILED DESCRIPTION OF PREFERRED EMBODIMENT

Figure 1:
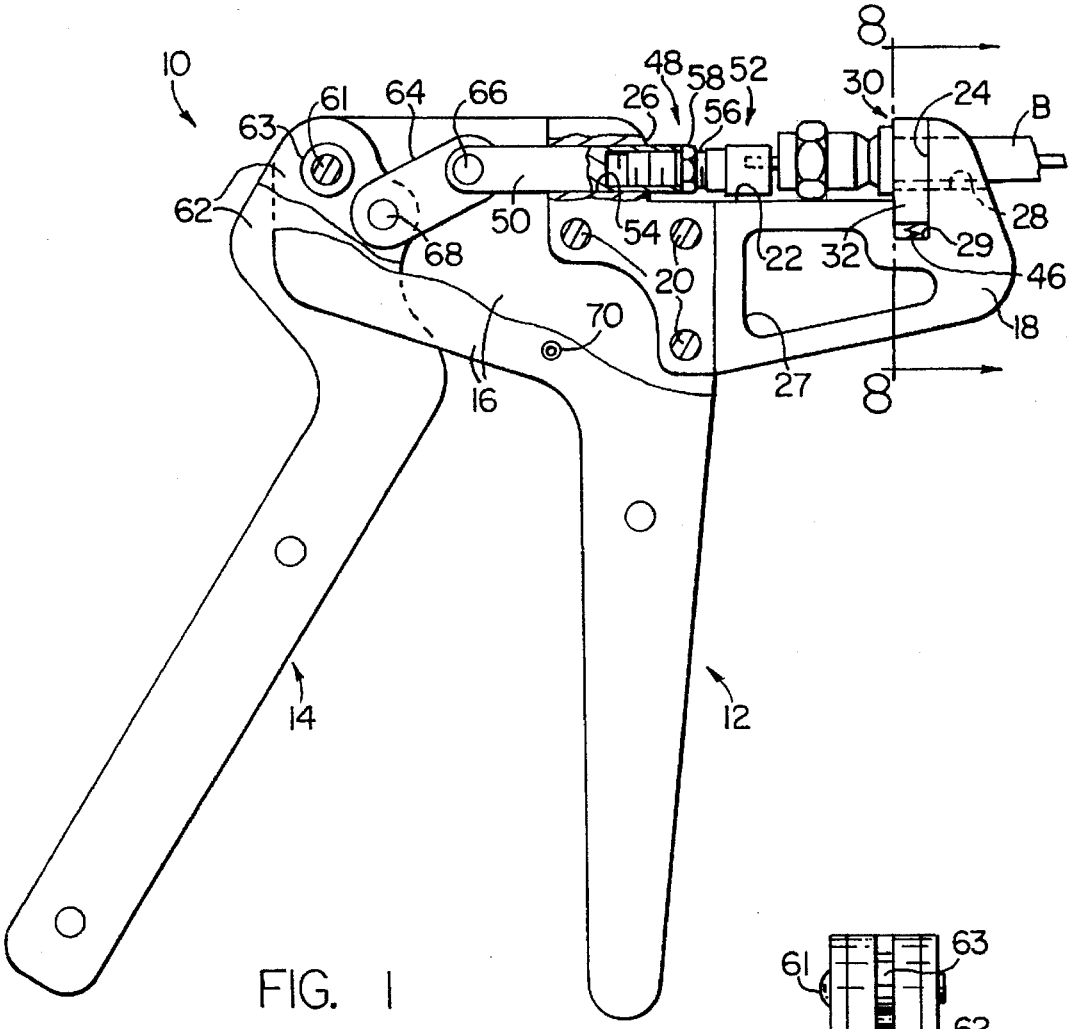
FIG. 1 is a side elevational view of a cable terminating tool embodying the present invention shown with its plunger assembly in retracted position, a cable to be terminated positioned in the tool and portions of the tool broken away to reveal structure therebehind.
Figure 6:
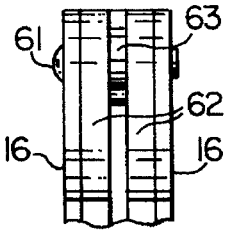
FIG. 6 is a fragmentary rear elevational view of the tool.
Figure 2:
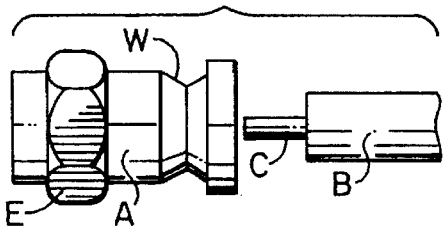
FIG. 2 is a somewhat enlarged exploded fragmentary view of a typical connector and cable before assembly.
Figure 3:
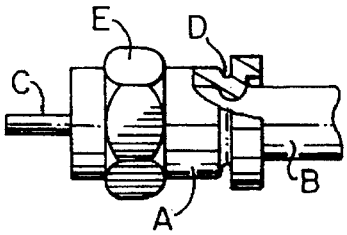
FIG. 3 is a side elevational view showing the connector and cable of FIG. 2 after assembly, a portion of the connector being shown in axial section to reveal the crimp formed by the tool.
Figure 7:
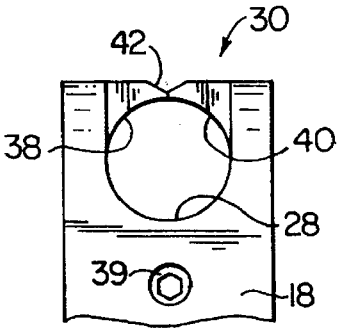
FIG. 7 is a somewhat enlarged fragmentary front elevational view of the tool.

Turning now to the drawings, in FIGS. 1 a cable terminating tool embodying the present invention is indicated generally by the reference numeral 10. The illustrated tool 10 is particularly adapted to apply a compression type connector fitting to an end portion of an axially elongated cable and in FIGS. 2 and 3 a typical connector of the aforedescribed general type is shown and indicted generally by the letter A. The illustrated connector A is particularly adapted for attachment to a coaxial cable and has an integral annular band of weakened material W, shown in FIG. 2 which collapses radially inwardly and into crimping engagement with an insulated end portion of the outer insulation jacket of a cable in response to axially directed compressive force applied to the connector. FIG. 3 shows the connector A after attachment to a coaxial cable designated by the letter B and having a central conductor C. The crimped portion of the conductor body which secures it to the cable, is indicated by the letter D. The illustrated connector A includes a nut E which is free to rotate relative to the connector body for securing the connector A to a mating male connector part (not shown). It should be noted that the central conductor C extends for some distance beyond the end of the applied connector.

Figure 4:
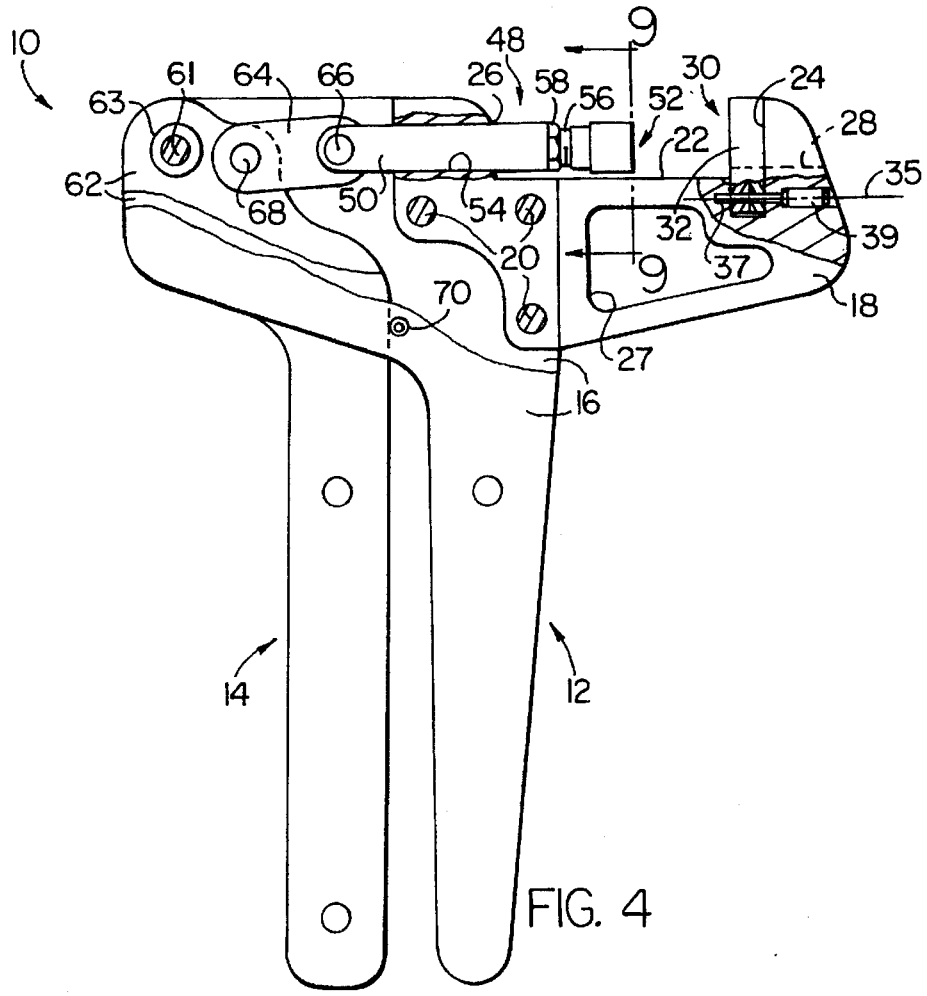
FIG. 4 is a side elevational view of the tool shown with its plunger assembly in compressing position.
Figure 5:
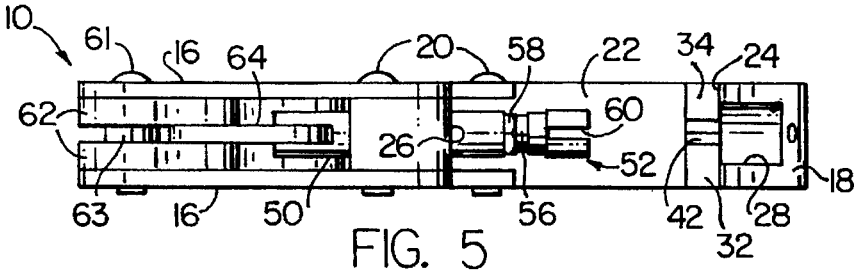
FIG. 5 is a plan view of the tool.

Further considering the cable terminating tool, the illustrated tool 10 has a pair of manually moveable operating handles indicated generally at 12 and 14. In accordance with presently preferred construction the handle 12 comprises a pair of handle side plates 16,16 secured together in spaced apart relation to each other at the rear and further secured adjacent opposite sides of a tool holder 18 by fasteners 20,20. The tool holder 18 projects forwardly from the handle 12 in a direction generally normal to the direction of handle extent. As shown oriented in the drawings, the tool holder 18 has an upwardly and laterally outwardly open notch 22 partially defined by opposing notch front and rear end walls 24 and 26. An upwardly open cable receiving groove 28 formed in the forward end portion of the tool holder 18, opens through the front end wall 24 and communicates with the notch 22. A shallow upwardly open recess 29 formed in the tool holder 18 and partially defined by the notch front wall 24 opens into the notch 22 as best shown in FIGS. 1 and 4. Shallow recesses 27,27 (one shown) are formed in opposite cheeks of the tool holder 18 to lighten the weight of the tool 10.

Figure 8:
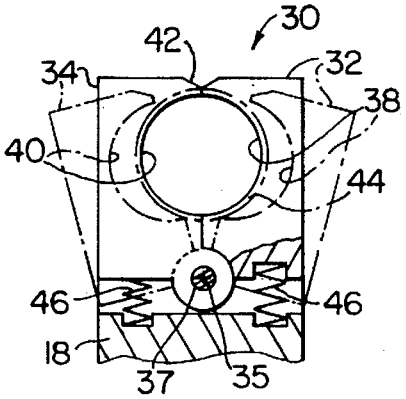
FIG. 8 is a somewhat enlarged fragmentary sectional view taken along the line 8—8 of FIG. 1.
Figure 9:
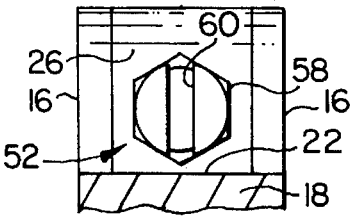
FIG. 9 is a somewhat enlarged fragmentary sectional view taken along the line 9—9 of FIG. 4.

Referring now to FIGS. 1,4 and 8 a yoke assembly indicated generally at 30 which includes a pair of cable retaining members 32 and 34 is mounted on the tool holder 18 within and at the forward end of the notch 22 generally adjacent the rearwardly facing front wall 24. The cable retaining members 32 and 34 are supported for pivotal movement on the tool holder 18 and about a common axis 35 within the notch 22 by a pivot pin 37 received within a bore opening through the forward end of the tool holder 18 as best shown in FIG. 4. The pivot pin 37 is retained in the tool holder 18 by a fastener 39 threadably engaged with the tool holder 18. The cable retaining members 32 and 34 define opposing arcuate jaws 38 and 40 and are pivotably moveable between a cable retaining position shown in full lines in FIG. 8 and a cable receiving position indicated by broken lines. Each cable retaining member has a downwardly and inwardly inclined chamfer at its upper inner end. The chamfered portions of the cable retaining members 32 and 34 define an upwardly diverging generally V-shaped notch 42 when the members 32 and 34 are in the cable receiving position, as shown in FIG. 8, for a purpose which will be hereinafter further evident. In the cable retaining position the arcuate jaws 38 and 40 cooperate to completely encircle a cable position therebetween. The cable retaining members 32 and 34 further cooperate in the cable retaining position to define a rearwardly facing annular bearing surface shown in phantom in FIG. 8 and indicated by the reference numeral 44. A pair of springs 46,46 disposed within the recess 29 act between the tool holder 18 and each of the cable retaining members 32 and 34 to urge the latter members toward cable retaining position.

The illustrated cable terminating tool 10 further includes a cylindrical plunger assembly indicated generally at 48 and having a plunger 50 and a plunger tip designated generally by the refernce numeral 52. The plunger 50 is slidably received within a complementary bore 54 which extends rearwardly through the rear portion of the tool holder 18 and opens into the notch 22 through the notch rear end wall 26. The illustrated plunger tip 52 is generally cylindrical and sized to engage an end portion of an associated connector such as the connector A shown in FIGS. 2 and 3. An integral threaded stud 56 projects coaxially rearwardly from the plunger tip 52, threadably engages the plunger 50 and is secured in fixed position relative to the plunger by a lock nut 58 received on the threaded stud 56, substantially as shown. A slot 60 extends diametrically through the front part of the plunger tip 52 and opens through the forward end of the plunger tip for a purpose which will be hereinafter explained.

The handle 12 is pivotally connected to the handle 14 by a pivot pin 61 and spacer 63 and like the handle 14 is formed by a pair of spaced apart handle side plates 62,62. Connection between the handle 14 and the plunger 50 is provided by a toggle link 64. One end of the link 64 is received within a rearwardly open slot in the rear end part of the plunger 50 and is secured thereto by a pivot pin 66. The opposite end of the toggle link 64 is disposed between the handle side plate 62,62 and pinned thereto by another pivot pin 68.

A roll pin 70 mounted in fixed position on the handle 12 and extending between the handle side plates 16,16 is positioned for engagement by an associated portion of the handle 14, limits travel of the handle 14 toward the handle 12 and also prevents the occurrence of a pinch point between the two handles. As previously noted the plunger tip 52 is threadably engaged with the plunger 50. The plunger tip 52 is adjustable relative to the plunger 50 to provide a proper spacing between the forward end of the plunger assembly 48 and the yoke 30 to control the compressive force applied to the connector to be secured to a cable. When the tool 10 is properly adjusted the roll pin 70 limits the force which can be applied to a connector by operating the handles 12 and 14, as will be hereinafter further evident.

Figure 11:
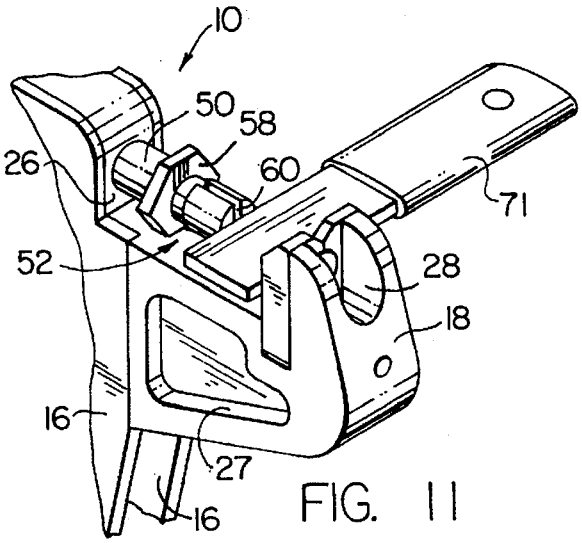
FIG. 11 is a fragmentary prospective view of the tool shown with a gauge therein.
Figure 12:
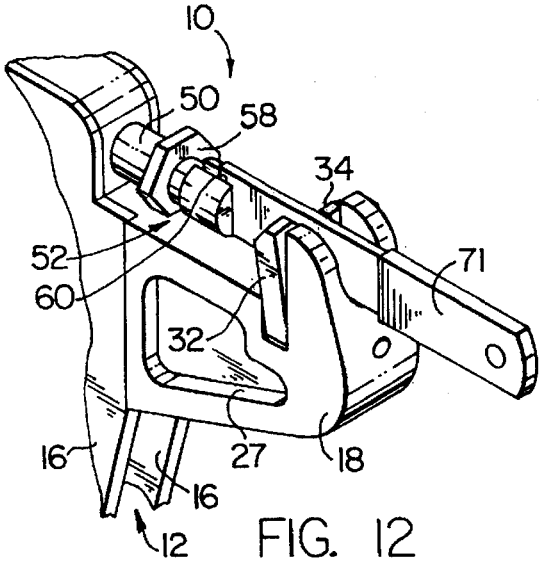
FIG. 12 is a fragmentary prospective view of the tool shown with the gauge in another position relative to the tool.
Figure 13:
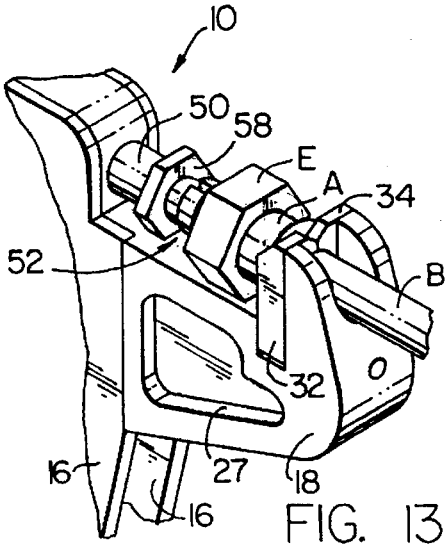
FIG. 13 is a fragmentary perspective view of the tool shown with a connector and cable positioned therein.

Preparatory to terminating a cable with the tool 10 the spacing between the forward end of the plunger assembly and the cable retaining members 32 and 34 is set using the gauge such as the gauge 71 shown in FIG. 11. When the proper spacing has been set by rotating the plunger tip 52 relative to the plunger 50 the slot 60 is set in a vertically disposed position after which the lock nut 58 is threaded into locking engagement with the plunger 50 to secure the plunger into its properly adjusted position. The gauge 71 is sized so that the end of the gauge may be inserted into the slot 60 to hold the plunger tip 52 in its proper position of adjustment while the lock nut 58 is threaded into locking engagement with the plunger 50.

A coaxial cable, such as the cable B hereinbefore described is prepared for termination by removing a portion of the outer insulation jacket and core material at the end of the cable to expose a predetermined length of the central conductor C. Thereafter a connector, such as the connector A, is positioned on the prepared end portion of the cable B by pushing it onto and seating it on the cable. The cable with the connector seated thereon is now ready for insertion into the tool. The cable is inserted into the tool 10 by forcing it downwardly into the cable receiving groove 28 at the forward end of the tool. An associated portion of the cable B adjacent the connector A engages the chamfered surfaces on the cable retaining members 32 and 34 which define the V shaped notch 42. These chamfered or lead surfaces cooperated with the cable to cam the cable retaining members 32 and 34 outwardly toward the cable receiving position shown in broken lines in FIG. 8 so that the cable B can be easily seated in the tool with the connector A in the notch 22. When the cable is properly positioned in general coaxial alignment with the plunger assembly 48 the cable retaining members return to cable retaining position in response to the biasing force of the springs 46,46. Since the arcuate jaws 38 and 40 completely encircle the cable in the cable retaining position the cable cannot move upwardly and out of the tool once it has been properly positioned therein. Thus the cable retaining members function to position the cable and the connector in alignment with the plunger assembly and retain the cable in the tool. The conductor A is now assembled with or secured to the cable B by applying squeezing force to the handles 12 and 14 to bring the handles together and thereby move the plunger assembly 48 into a compressing engagement with the connector A which is supported by the annular bearing surface 44 defined by the cable retaining members 32 and 34 in cable retaining position. The entire forward by facing surface of the connector A engages the rearwardly facing bearing surface 44. This arrangement assures that the compressive force applied by the plunger is equally distributed about the annular band of weakening W so that a substantially uniform crimp is attained each time the tool is used to assemble a connector with an associated cable.

After the assembly has been completed the handle 14 is pivoted away from the handle 12 to retract the plunger assembly 48. Light finger pressure applied to the cable retaining members 32 and 34 within the notch 42 is sufficient to spread the latter members toward the cable releasing position indicated by broken lines in FIG. 8 whereby the arcuate jaws 38 and 40 release the cable. The opening or slot 60 at the forward end of the plunger assembly is sized to permit free movement of the extending end portion of the central conductor "C" therethrough so that the terminated coaxial cable may be easily removed from the tool 10. The provision of the slot 60 permits the tool to operate with minimal plunger stroke.

It will now be apparent that the pistol grip arrangement of the tool handles 14 and 16 relative to the tool holder provides a tool which is very comfortable to handle and use. Further, the overall design of the tool provides a well balanced package as will be evident from FIG. 4.

A plurality of plunger tips of different lengths, and or configuration may he provided for selective use to adapt the tool to apply connectors produced by different manufacturers. In each instance, an appropriate gauge may be provided for adjusting the tool. Where such an arrangement is employed a color coded band may be provided on each plunger tip matching a color code on the handle of the gauge for setting the tool and identifying the connector with which the particular plunger tip is to be used.

Figure 10:
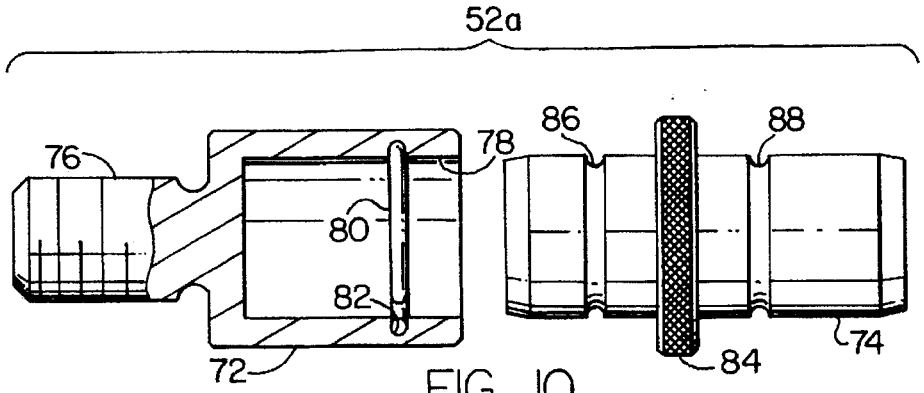
FIG. 10 is a somewhat enlarged exploded view of a reversible plunger tip shown partially in axial section.

Referring now to FIG. 10 another plunger tip for use with the tool 10 is indicated generally at 52*a*. The illustrated tip 52*a* comprises a plurality of parts and includes a rear part 72 and a front part 74. The rear part is generally cylindrical and has a coaxial rearwardly extending threaded shank 76 adapted for threadable engagement with the plunger 50, and a coaxial blind bore 78 which opens through its forward end. A resilient split wire snap ring 80 is loosely received within an annular groove 82 opening into the bore 78 in axially rearwardly spaced relation to the forward end of the cylindrical part 72.

The front part 74 is generally cylindrical and sized to be slideably received within the bore 78. An integral diametrically enlarged annular band 84 coaxially surrounds the front part 74. The band is located closer to one end of the front part 74 than to the other end of the part and is preferably knurled to provide a gripping surface. A pair of annular grooves 86 and 88 are formed in the cylindrical part 74 each groove being equally spaced in an axial direction from the annular band 84.

The front part 74 is adapted for reversible connection with the rear part 72 carried by the tool plunger. Thus, when ether end of the front part 74 is slideably positioned within the bore 78 the snap-ring 83 engages an associated one of the grooves 86 or 88 to releasably retain the front part 74 in connected engagement with the rear part 72. In assembly, the annular band 84 engages the front wall of the rear part 72.

The illustrated plunger tip 52*a* is particularly suitable for use where two similar connectors of differing axial length are being applied to a plurality of associated cables. The tool may be rapidly set up to apply either of the two connectors by simply reversing the position of the front part 74 relative to the rear part 72.

It will now be evident that a reversible plunger tip, such as the tip 52*a*, may be provided with a front part having end portions of differing size and/or configuration so that the tool 10 may be readily adapted to apply a wide range of connector fitting of compression type.

We claim:

1. A cable terminating tool for applying an electrical connector to an end portion of a cable and comprising a tool holder, cable retaining means for positioning and retaining a cable to be terminated and including a pair of cable retaining members having opposing arcuate jaws supported for movement away from each other and to a cable receiving position to receive therebetween an associated portion of a cable to be terminated and toward each other and to a cable retaining position to restrain the associated portion of the cable to be terminated, said cable retaining members in said cable retaining position encircling the associated portion of the cable and defining an annular bearing surface for engaging a connector received on the end portion of the cable to be terminated, a plunger assembly including an axially elongated plunger supported on said tool holder for axial movement toward and away from said bearing surface, and manual operating means connected to said plunger assembly for moving said plunger relative to said tool holder and in a direction toward and away from said bearing surface.

2. A cable terminating tool as set forth in claim 1 including biasing means for urging said cable retaining members toward said cable retaining position.

3. A cable terminating tool as set forth in claim 2 wherein said biasing means comprises a pair of springs acting between said cable retaining members and said tool holder.

4. A cable terminating tool as set forth in claim 1 wherein said cable retaining members are pivotally supported on said tool holder.

5. A cable terminating tool as set forth in claim 4 wherein said cable retaining members are supported for pivotal movement about a common axis.

6. A cable terminating tool as set forth in claim 1 wherein said manual operating means comprises a pair of handles and said tool holder is integrally connected to one of said handles.

7. A cable terminating tool as set forth in claim 6 wherein the other of said handles is pivotally supported on said one handle.

8. A cable terminating tool as set forth in claim 7 wherein said plunger assembly includes connecting means for attaching the other of said handles to said plunger.

9. A cable terminating tool as set forth in claim 8 wherein said connecting means comprises a toggle link.

10. A cable terminating tool as set forth in claim 6 wherein said handles extend in transverse directions relative to the axis of said plunger.

11. A cable terminating tool as set forth in claim 1 wherein said plunger includes adjusting means for varying the effective length of said plunger.

12. A cable terminating tool as set forth in claim 11 wherein said adjusting means comprises a plunger tip adjustable connected to said plunger.

13. A cable terminating tool as set forth in claim 12 wherein said plunger tip comprises a plurality of parts and one of said parts is releasably connected to another of said parts.

14. A cable terminating tool as set forth in claim 13 wherein said one of said parts is reversible relative to said another of said parts.

15. A cable terminating tool as set forth in claim 12 wherein the cable comprises a coaxial cable having a central conductor and said plunger tip has a slot extending diametrically thereacross and opening through an end thereof toward said bearing surface and sized to allow the central conductor to pass therethrough.

16. A cable terminating tool as set forth in claim 1 wherein the cable comprises a coaxial cable having a coaxially extending central conductor and said plunger assembly has an end portion defining an opening for receiving a portion of the central conductor therein.

17. A cable terminating tool as set forth in claim 16 wherein said opening comprises a diametrically extending slot.

18. A cable terminating tool comprising a pair of elongated handles including a first handle having a tool holder at an end thereof projecting forwardly therefrom, said tool holder having an upwardly and laterally outwardly open notch partially defined by opposing front and rear end walls, said tool holder having a forwardly and upwardly open cable receiving recess in the forward end portion thereof opening through said front end wall, cable retaining means for positioning and releasably retaining an associated portion of a cable to be terminated and including a pair of cable retaining members supported on said tool holder and disposed within said notch adjacent said front end wall, said cable retaining members having opposing arcuate jaws supported for movement away from each other and to a cable receiving position and toward each other and to a cable retaining position, said jaws in said cable retaining position encircling an associated portion of a cable positioned therebetween and defining an annular rearwardly facing bearing surface generally coaxially encircling the cable, biasing means for urging said retaining members toward said cable retaining position, an axially elongated plunger assembly supported by said tool holder for axial movement in a direction generally toward and away from said bearing surface, a second handle pivotally connected to said first handle, and a toggle link pivotally connected to said plunger assembly and said second handle for moving said plunger assembly toward and away from said bearing surface in response to movement of said handles toward and away from each other.

19. A hand tool as set forth in claim 18 wherein cable comprises a coaxial cable having a central conductor and said plunger assembly has an axially extending slot opening through the end thereof facing said bearing surface and extending diametrically therethrough for receiving the central conductor and allowing the central conductor to pass freely therethrough.

20. A cable terminating tool as set forth in claim 18 wherein said cable retaining members are pivotally supported on said tool holder.

21. A cable terminating tool as set forth in claim 20 wherein said cable retaining members are supported for pivotal movement about a common axis.

22. A cable terminating tool as set forth in claim 21 wherein said biasing means comprises a pair of springs acting between said retaining members and said tool holder.

23. A cable terminating tool as set forth in claim 18 wherein said tool holder is mounted on an upper end of said first handle and projects from said first handle in a direction generally normal to the direction of handle extent.

24. A cable terminating tool for pressing an electrical connector into crimping engagement with an end portion of an associated axially elongated coaxial cable and comprising a pair of elongated handles including a first handle having a tool holder at an end thereof projecting forwardly therefrom, said tool holder having an upwardly and laterally outwardly open notch partially defined by opposing front and rear end walls, said tool holder having a forwardly and upwardly open cable receiving recess in the forward end portion thereof opening through said front end wall, cable retaining means for positioning and retaining an associated portion of an axially elongated cable received in said cable receiving recess and extending into said notch and including a pair of cable retaining members disposed within said notch adjacent said front end wall, pivot means for supporting said cable retaining members for pivotal movement relative to each other and to said tool holder about a common pivotal axis for movement generally away from each other to a cable receiving position to receive an associated portion of a cable therebetween and toward each other and to a cable holding position, said cable retaining members having opposing arcuate jaws for encircling an associate portion of a cable in said cable retaining position, said cable retaining members cooperating in said cable retaining position to define a generally radially disposed rearwardly facing annular bearing surface for engagement by an electrical connector received on the end of a cable to be terminated, biasing means for urging said cable retaining members toward said cable holding position and including a pair of springs, each of said springs acting between said tool holder and an associated one of said cable retaining members, an axially elongated plunger assembly of variable axial length supported for axial sliding movement by and relative to said tool holder, said plunger assembly including a plunger and a plunger tip connected to said plunger for threadable adjustment relative to said plunger to alter the effective length of said plunger assembly, said plunger tip having a front surface disposed in opposing relation to said bearing surface for engaging a connector to be crimped into engagement with a cable, and manual operating means for moving said plunger assembly in a direction toward and away from said bearing surface and including a second handle pivotally connected to said first handle and a toggle link connected to said second handle and to said plunger.

25. A cable terminating tool as set forth in claim 24 wherein the cable comprises a coaxial cable having a coaxially extending central conductor and said plunger assembly has an opening in its forward end for receiving a portion of the central conductor therein.

26. A cable terminating tool as set forth in claim 25 wherein said opening comprises a diametrically extending slot.

27. A cable terminating tool as set forth in claim 24 wherein said tool holder projects forwardly from said first handle in a direction normal to the direction of extent of said first handle.

* * * * *